US006432034B1

(12) United States Patent
Hedin et al.

(10) Patent No.: US 6,432,034 B1
(45) Date of Patent: Aug. 13, 2002

(54) LOOKING RING FOR A CENTRIFUGAL SEPARATOR

(75) Inventors: Sven Hedin, Huddinge; Kjell Lintenstedt, Saltsjö-Boo; Toini Salmi, Sorunda, all of (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/890,418

(22) PCT Filed: Mar. 8, 2000

(86) PCT No.: PCT/SE00/00455

§ 371 (c)(1),
(2), (4) Date: Jul. 27, 2001

(87) PCT Pub. No.: WO00/53327

PCT Pub. Date: Sep. 14, 2000

(30) Foreign Application Priority Data

Mar. 9, 1999 (SE) ..... 99 00861

(51) Int. Cl.[7] ..... B04B 15/00
(52) U.S. Cl. ..... 494/85
(58) Field of Search ..... 494/12, 38, 43, 494/64, 68–73, 85; 210/360.1, 380.1

(56) References Cited

U.S. PATENT DOCUMENTS 2,087,630 A * 7/1937 Schelbeck
2,483,342 A * 9/1949 Henrard
2,668,658 A 2/1954 Peltzer
3,408,000 A * 10/1968 Nilson
3,463,388 A * 8/1969 Salmon
4,026,462 A * 5/1977 Tenthoff et al.
4,059,223 A * 11/1977 Lewis
4,067,494 A * 1/1978 Willus et al.
4,164,317 A * 8/1979 Nelson
4,191,325 A * 3/1980 Stroucken et al.
4,464,163 A * 8/1984 Heckmann et al.
4,479,788 A * 10/1984 Kohlstette
4,698,053 A * 10/1987 Stroucken
4,710,160 A 12/1987 Klintenstedt
4,729,759 A * 3/1988 Krook et al.
4,759,744 A * 7/1988 Krook
4,840,612 A * 6/1989 Pallmar
5,052,996 A * 10/1991 Lantz

FOREIGN PATENT DOCUMENTS

EP 23252 * 2/1981
SU 579020 * 11/1977
WO 88/03439 * 5/1988

* cited by examiner

*Primary Examiner*—Charles E. Cooley
(74) *Attorney, Agent, or Firm*—McCormick, Paulding & Huber LLP

(57) ABSTRACT

A locking ring for joining a first and second of a rotor in a centrifugal separator, the first rotor part having a cylindrical end portion, and the second part having an annular flange. A locking ring is arranged to be positioned into a recess and via two radially outer contact surfaces to abut against the end portion and via inner contact surfaces to abut against the flange. The locking ring extends substantially a complete revolution around the rotational axis with two end surfaces turned towards one another and being so formed out of a single piece of resilient material that in an unloaded condition is substantially annular with an outer diameter, is at least as large as the outer radius of the recess, the contact surfaces being are so located that they in every axial section around the rotational axis have a middle point, in which the contact surface have a direction of normalcy, which is the for all contact surfaces. In the direction towards the separation chamber in the interior of the rotor the locking ring forms an acute angle with the rotational axis.

5 Claims, 2 Drawing Sheets

LOOKING RING FOR A CENTRIFUGAL SEPARATOR

FIELD OF THE INVENTION

The present invention generally relates to centrifuge rotors, and is more specifically directed to the mechanism whereby rotor parts are coupled together.

BACKGROUND AND SUMMARY OF THE PRESENT INVENTION

The present invention concerns a locking ring for joining a first and a second part of a rotor in a centrifugal separator, which rotor is arranged to rotate around a rotational axis and delimits within itself a separation chamber. The first rotor part has a circular cylindrical end portion, which has an inner radius and a center line, which coincides with the rotational axis. The second part has an annular flange portion, which extends around the rotational axis in a plane perpendicular to the rotational axis. The flange portion has an outer radius, which is approximately as large as the inner radius of the circular cylindrical end portion, the flange portion being insertable in the end portion of the first part in one axial direction against a stop arranged in the rotor and is adapted to be lockable in the opposite axial direction by means of a locking joint comprising the locking ring. When assembling the rotor, the locking ring is arranged to be brought radially outwardly from a position radially inside the inside of the circular cylindrical end portion and axially outside the annular flange portion into a recess extending around the rotational axis in the inside of the circular cylindrical end portion with a certain outer radius so that a radial outer portion of the locking ring extends out into a recess, whereas a remaining radial inner portion of the locking ring extends radially inside the outer radius of the flange portion and so that the outer portion of the locking ring abuts against the circular cylindrical end portion via two radially outer identical contact surfaces and so that the inner portion of the locking ring abuts against the flange portion via two radially inner identical contact surfaces. The contact surfaces are essentially rotationally symmetrical around the rotational axis and are adapted to transfer the axial forces due to the liquid pressure in the separation chamber on the second rotor part to the first rotor part.

Rotor parts of centrifugal separators are often joined together by means of screw joints, in which a big locking ring having an external thread surrounding the rotational axis is screw tight in an internal thread of a circular cylindrical portion of the one rotor part.

BACKGROUND OF THE INVENTION

Above all, locking joints of this kind cause high manufacturing costs, as well as assembling and disassembling costs. Besides, these joints are exposed to heavy loads, which lays high demands on dimensioning, choice of material etc. It might even happen that the material in the threads is exposed to such high loads that the threads seize during assembly when a certain pre-load is being established.

In U.S. Pat. No. 4,710,160 another locking joint is disclosed. In this locking joint two or more locking rings are brought radially out into an internal groove in a circular cylindrical portion of one rotor part. The disclosed locking ring is fixed in the groove and is pre-loaded by means of tightening rings in a mating rotor part.

By this method, a locking joint is accomplished, which reduces the disadvantages mentioned above. However, the locking joint comprises several components, which must be manufactured, assembled, and occasionally be disassembled and re-assembled. Consequently, this locking joint causes high manufacturing costs and handling costs.

The object of the present invention is to accomplish a locking, by means of which these disadvantages are further reduced without jeopardizing the safety of the locking joint.

SUMMARY OF THE INVENTION

According to the present invention this is accomplished by the fact that the locking ring extends substantially a complete revolution around the rotational axis with two end surfaces turned towards one another in the circumferential direction and being so formed in one single integrated piece out of an elastically resilient material that it, in the unloaded condition tends to be substantially annular shaped with an outer radius, which is at least as large as the outer radius of the recess. The contact surfaces are located and directed so that in every axial section around the rotational axis there is a middle point, in which the contact surfaces have a direction of normalcy. This middle point is common and coinciding for all the contact surfaces, and in a direction towards the separation chamber in the interior of the rotor forming an acute angle with the rotational axis. The contact surfaces are substantially symmetrical with respect to this direction of normalcy.

Thereby, the resulting force on the locking ring from the first rotor part and the resulting force of equal strength but counter directed from the other rotor part become located just opposite one another in every axial section around the rotational axis, resulting in the locking ring not being exposed to any forces that tend to bring the locking ring out of the recess.

In a preferred embodiment all the contact surfaces are parallel and conical. Preferable the locking ring has a retangular cross-section.

In another embodiment of the invention, the locking ring has such an extension (1) in the circumferential direction and such a radial thickness (t) that the distance in the circumferential direction between the end surfaces in mounted state is less than 3.14 t.

In a variation of this embodiment, the locking ring has such an extension in the circumferential direction and such a radial thickness (t) that the distance in the circumferential direction between the end surfaces in mounted state is less than 1.5 t.

BRIEF DESCRIPTION OF THE DRAWINGS

In the following, the invention is described more closely with reference to the figures on the attached drawings in which:

In FIG. 1 a part of a rotor, generally referred to by reference number 22, of a centrifugal separator is shown, which is provided with a locking ring 1 according to the present invention. The rotor 22 is rotatable around a rotational axis R and has a first part 2 and a second part 3. The first part 2 has a circular cylindrical end portion 4, the center line of which coincides with the rotational axis R. The second part 3 has an annular flange portion 5, which extends around the rotational axis R in a plane perpendicular to the rotational axis R. The circular cylindrical end portion 4 of the first part 2 has an inner radius $r_2$ larger than the outer radius $r_1$ of the flange portion 5 so that the flange portion 5 is axially insertable into the end portion 4 against a stop 6 arranged in the first part 2 of the rotor 22. The inside surface 24 of the end portion 4 is designed with a recess 7, which extends around the rotational axis R and has in this embodiment a radial outer conical contact surface 8 with a direction of normalcy, which is directed axially and inclined radially inwardly towards the rotational axis R.

The locking ring 1 has a frusto-conical shape with a rectangular cross-section and extends essentially a complete revolution around the rotational axis R. Referring to FIG. 3, the locking ring 1 has two end surfaces 26, 28, which are turned towards one another in the circumferential direction. The locking ring 1 is so formed in one single integrated piece by an elastically resilient material that it in unloaded condition tends to be essentially annular shaped with an outer radius $r_3$ which at least is as large as the outer radius $r_4$ of the recess 7 (see FIG. 1). Continuing with FIG. 1, the locking ring is arranged to be able to be brought from a position radially inside the inside of the end portion 4 radially outwardly into the recess 7 when the second part 3 of the rotor has been brought axially towards the stop 6.

Figure 1:
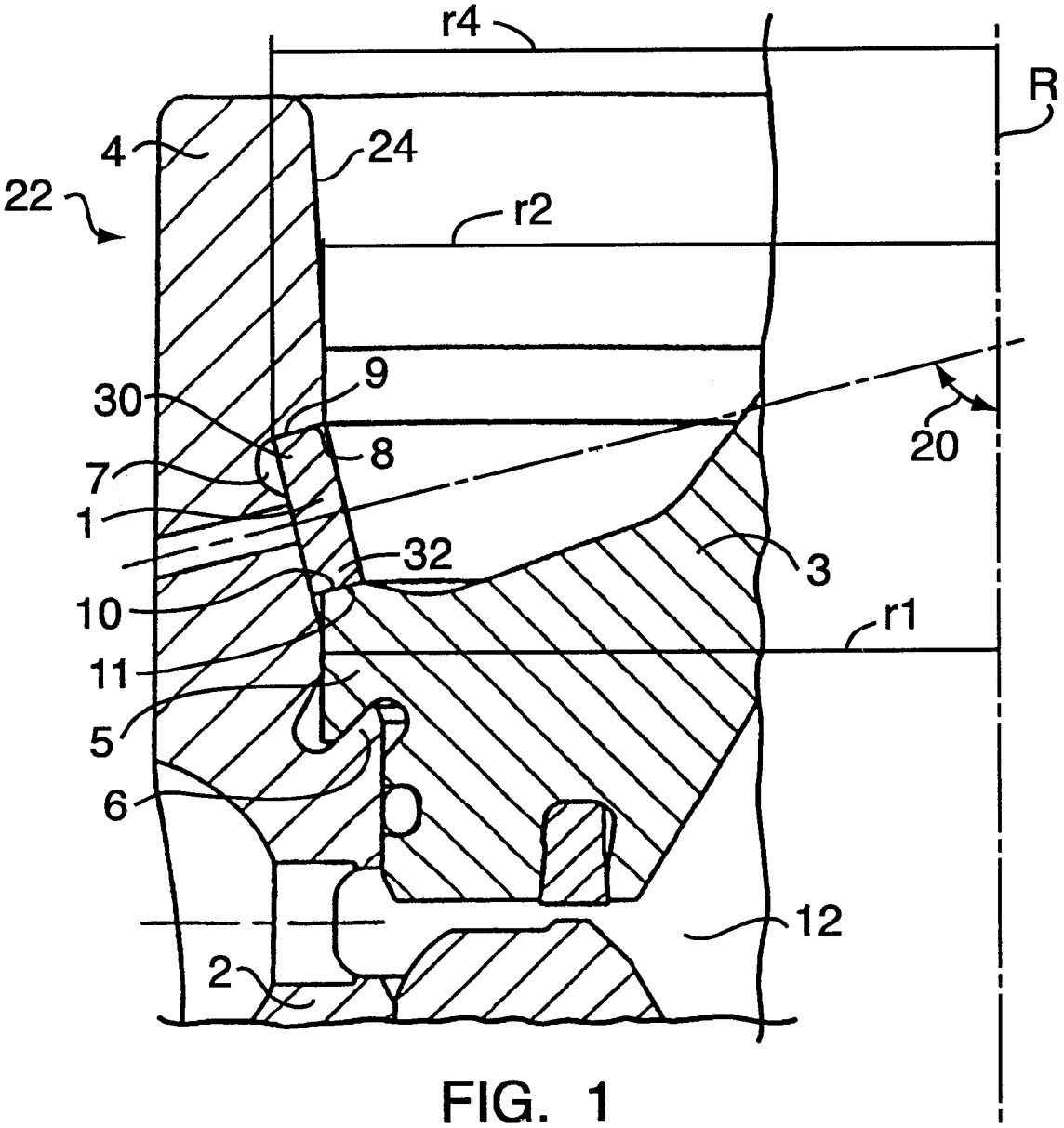
FIG. 1 schematically shows an axial section through a part of a centrifugal separator, which is provided with one embodiment of a locking ring according to the invention.
Figure 3:
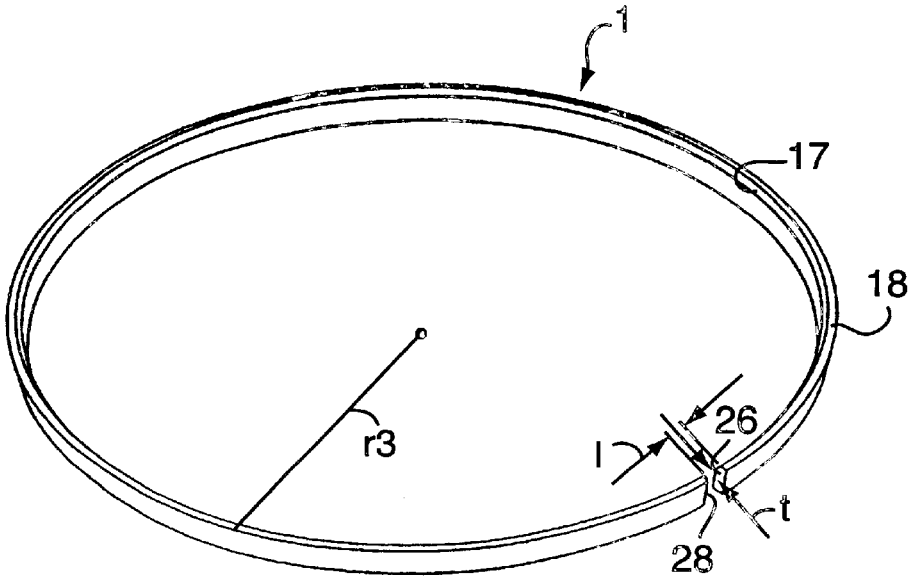
FIG. 3 shows a three dimensional view of a further embodiment of a locking ring according to the invention.

In order to make this possible as can be seen from FIG. 1 and FIG. 3, one end 26 and 28 of the locking ring 1 can be bent radially inwardly and brought pass the other axial end 26 and 28 of the locking ring 1 in the circumferential direction so that the locking ring 1 obtains an outer radius, which is less than the inner radius $r_2$ of the end portion 4. To prevent this for certain from happening during operation, the locking ring 1 has such an extension in the circumferential direction (l) and such a radial thickness (t) that the distance in the circumferential direction l between the end surfaces 26 and 28 in assembled condition is less than 3.14 t, preferably less than 1.5 t.

Continuing with FIG. 1, the recess 7 has such an outer radius $r_4$ that the locking ring 1 when it is mounted in the recess 7 extends out into the recess 7 with a radially outer portion 30 thereof whereas the remaining radially inner part 32 of the locking ring 1 extends radially inside the outer radius $r_5$ of the flange portion 5. The locking ring 1 has an outer conical contact surface 9 that abuts a corresponding outer conical contact surface 8 of the recess 7, and the locking ring 1 further having an inner conical contact surface 10 that abuts a corresponding conical contact surface of the annular flange 5.

The contact surfaces 8,9,10 and 11 are so located and directed that they in each axial section around the rotational axis R each contact surface has a middle point 13, in which the contact surfaces 8,9,10 and 11 have a direction of normalcy, which for all the contact surfaces 8,9,10 and 11 is common and coinciding, and which in direction towards the separation chamber 12 in the interior of the rotor forms an acute angle 20 with the rotational axis R, the contact surfaces 8,9,10 and 11 being substantially symmetrical around this direction of normalcy.

Figure 2:
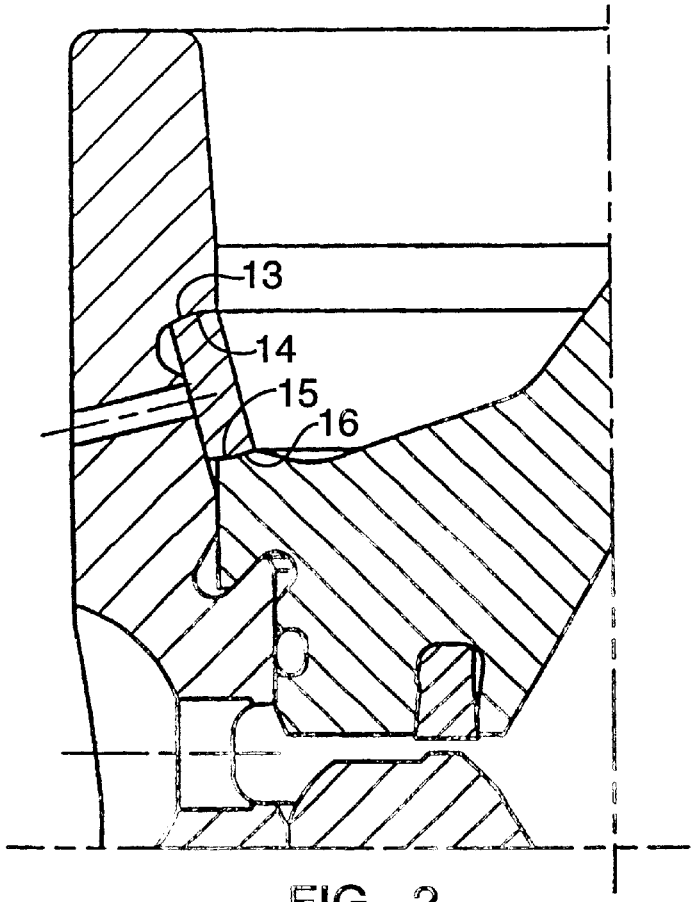
FIG. 2 schematically shows an axial section through a part of a centrifugal separator, which is provided with another embodiment of a locking ring according to the invention.

The embodiment of a locking ring according to the present invention shown in FIG. 2 differs from the embodiment shown in FIG. 1 in that the radially outer conical contact surface 13, the outer conical contact surface 14, the inner conical contact surface 16 and the inner conical contact surface 15 in an axial section has a curved preferably circular, shape.

In FIG. 3 a further embodiment of a locking ring according to the invention is shown three dimensionally, which has a bevelled inner edge 17 at its radially outer contact surface 18, which is arranged to abut against the contact surface of the recess.

In order to polar guide, i.e. position the locking ring consistently in the recess, the locking ring 1, a thin projection can be arranged in the recess extending axially and radially from the locking ring 1 between the two end surfaces of the locking ring 1. Alternatively, the locking ring can be provided with a staff formed element on its outside surface of the locking ring arranged to be brought in a corresponding hole in the recess 7.

What is claimed is:

1. A locking ring for joining a first and a second part of a rotor in a centrifugal separator, which rotor is arranged to rotate around a rotational axis and delimits within itself a separation chamber, the first part having a circular cylindrical end portion, which has a certain inner radius and a center line, which essentially coincides with the rotational axis, and the second part having an annular flange portion, which extends around the rotational axis in a plane perpendicular to the rotational axis and which has an outer radius, which substantially is as large as the inner radius of the circular cylindrical end portion, the flange portion being insertable in the circular cylindrical end portion of the first part in one axial direction against a stop arranged in the rotor and in the inserted position being adapted to be lockable in an opposite axial direction by means of a locking joint comprising the locking ring, which when assembling the rotor is arranged to be brought radially outwardly from a position radially inside the inside of the circular cylindrical end portion and axially outside the annular flange portion into a recess extending around the rotational axis in the inside of the circular cylindrical end portion, wherein an outer contact surface of the locking ring extends into the recess and abuts an outer contact surface of the circular cylindrical end portion, and an inner contact surface of the locking ring abuts an inner contact surface of the annular flange portion, the contact surfaces being essentially rotationally symmetrical around the rotational axis and adapted to transfer axial forces due to the liquid pressure in the separation chamber from the second rotor part to the first part, the locking ring extending substantially a complete revolution around the rotational axis and having two end surfaces turned towards one another in the circumferential direction and formed in one single integrated piece out of an elastically resilient material, the locking ring in an unloaded condition tending to be substantially annular in shape with an outer diameter at least as large as an outer radius of the recess, and the inner and outer contact surfaces so located and directed that in every axial section around the rotational axis a middle point, in which the contact surfaces have a direction of normalcy, which is common and coinciding for all the contact surfaces and, in a direction towards the separation chamber in the interior of the rotor, forms an acute angle with the rotational axis, the contact surfaces being substantially symmetrical with $r_4$.

2. A locking ring according to claim 1, wherein the inner and outer contact surfaces are approximately parallel and conical.

3. A locking ring according to claim 2, wherein, the locking ring in an axial section has a rectangular cross-section.

4. A locking ring according to claim 1, wherein the locking ring has such an extension in the circumferential direction and such a radial thickness (t) that the distance (l) in the circumferential direction between the end surfaces in a mounted state is less than 3.14 t.

5. (Twice Amended) A locking ring according to claim 4, wherein the locking ring has such an extension in the circumferential direction and such a radial thickness (t) that the distance (l) in the circumferential direction between the end surfaces in a mounted state is less than 1.5.

* * * * *

UNITED STATES PATENT AND TRADEMARK OFFICE

CERTIFICATE OF CORRECTION

PATENT NO. : 6,432,034 B1
DATED : August 13, 2002
INVENTOR(S) : Sven Hedin et al.

It is certified that error appears in the above-identified patent and that said Letters Patent is hereby corrected as shown below:

Title page, Item [54] and Column 1, line 1,
Title, "LOOKING RING" should read -- LOCKING RING --

Title page,
Item [57], ABSTRACT,
Line 15, the word -- same -- should be inserted after "the".

Column 5,
Line 4, "Twice Amended" should be removed.

Signed and Sealed this

Twenty-fourth Day of June, 2003

JAMES E. ROGAN
*Director of the United States Patent and Trademark Office*